US006076198A

United States Patent [19]

Meierdierck

[11] Patent Number: 6,076,198

[45] Date of Patent: Jun. 20, 2000

[54] TUBULAR FILM DISPENSING APPARATUS

[75] Inventor: Charles Meierdierck, Hardy, Va.

[73] Assignee: T. Eliot, Inc., New York, N.Y.

[21] Appl. No.: 09/177,643

[22] Filed: Oct. 22, 1998

Related U.S. Application Data

[60] Provisional application No. 60/063,157, Oct. 24, 1997.

[51] Int. Cl.[7] ..... A47K 13/14

[52] U.S. Cl. ..... 4/243.2; 4/243.1

[58] Field of Search ..... 4/243.1, 243.2, 4/243.3

[56] References Cited

U.S. PATENT DOCUMENTS

| | | | |
|---|---|---|---|
| 4,926,504 | 5/1990 | Higuchi et al. | 4/243.3 |
| 5,203,036 | 4/1993 | Juushi | 4/243.3 |
| 5,253,372 | 10/1993 | Boker | 4/243.2 |

FOREIGN PATENT DOCUMENTS

| | | | |
|---|---|---|---|
| 4226616 | 8/1992 | Japan | 4/243.1 |

*Primary Examiner*—Robert M. Fetsuga
*Attorney, Agent, or Firm*—Schweitzer Cornman Gross & Bondell LLP

[57] ABSTRACT

An apparatus for dispensing measured lengths of toilet seat cover material onto a toilet seat and for collecting used cover materials includes an integrated system to improve performance. The apparatus includes sensors to determine the orientation of the seat to prevent dispensation when the seat is raised. Computer circuitry, programmable for different supply lengths of cover, displays the number of dispensations remaining and can provide warning signals as the remaining number decreases to a preset value. Communication with a remote control facility is provided to allow remote inquiry of the status of the apparatus, including the number of dispensations available.

13 Claims, 3 Drawing Sheets

90
98
μ PROC.
RESET
106
FLASH RAM
104
DISCRIMINATOR
100
MOTOR ACTIVATOR
92
I/O
110
102

66
90
92
96
94
68

TUBULAR FILM DISPENSING APPARATUS

This application claims benefit of Provisional application Ser. No. 60/063,137, filed Oct. 24, 1997.

The present invention relates to an improved apparatus for covering an armature, such as a toilet seat, with a measured length of flexible sleeve.

BACKGROUND OF THE INVENTION

The prior art discloses mechanisms by which a toilet seat or similar armature-like structure may be covered by a flexible sleeve or cover. Such covers are typically used, for example, to improve the sanitary condition of the armature or seat. The prior art discloses a variety of mechanisms for loading a length of protective sleeve on a toilet seat from a first, dispensing source and then collecting the dispensed section in a collection mechanism, typically while simultaneously dispensing a new length of sleeve onto the seat.

U.S. Pat. No. 5,253,372 discloses an apparatus of the aforementioned type in which the cover material is dispensed from a source or dispenser located at one end of the seat or other armature, and a collector or take-up means for the material at a second end. Drive means are connected to the source and take-up to permit a controlled length of the sleeving material to be withdrawn from the source and positioned along and about the length of the armature. At the same time, the previous length located on the armature is collected by the take-up.

A series of markings are provided along the length of the sleeve material to accurately and precisely meter the dispensing thereof. The markings are sensed by a fixed sensor, which generates a pulse-like output upon passage of a mark. The output of the sensor is operatively connected to a drive controller which controls the drive and take-up means as required, the drive continuing until a predetermined length of sleeve has been dispensed. Such determination occurs by the counting of pulses produced by the sensor as the marks pass the sensor as the tubular material is dispensed.

The prior art, as exemplified by the foregoing apparatus, may be subject to certain deficiencies. For example, it does not provide means by which the amount of sleeve material remains available for dispensation. Without means to monitor the number of actuations, the dispenser is subject to running out of sleeve material without prior notice.

In addition, operation of such dispensing systems typically is controlled by the manual activation of a switch. Such activation can be inconvenient and sometimes unsanitary.

In addition, it is known to have toilet seats which are pivotable between a raised and a lowered use position. To economize on the amount of sleeve material utilized, it can be of benefit to prevent the operation of the dispensing apparatus when the seat is in the upright position.

It is accordingly a purpose of the present invention to provide a new and improved sleeve material dispensing apparatus, such as for use in connection with a toilet, which provides for more economical operation and with greater control over the metering of the sleeve material than conventional dispensation systems.

A further purpose of the present invention is to provide a sleeve dispensing apparatus which includes means for determining and displaying the amount of sleeve material remaining for use.

Yet another purpose of the present invention is to provide an apparatus of the aforementioned type having the ability to communicate with a distant control facility and to report its status thereto.

Still a further purpose of the present invention is to provide a dispensing apparatus which allows dispensation to occur only when the armature upon which the material to be dispensed is in a proper operating position.

BRIEF DESCRIPTION OF THE INVENTION

In accordance with the foregoing and other objects and purposes, the apparatus of the present invention, which may incorporate the teachings of U.S. Pat. No. 5,252,372, the contents of which are incorporated herein by reference, comprises dispensation and take-up means located at opposed ends of an armature or seat connected to a drive controller. The drive controller is preferably microprocessor-based, and includes a non-contact sensor for initiating a dispensation cycle. The microprocessor may be located in a housing remote from the seat and motor, connected thereto by a cable. Means are provided to monitor the lengths of sleeve material dispensed and to display the amount of material remaining for dispensation. A position sensor may be mounted to the seat/armature and coupled to the microprocessor to prevent operation of the motor when the seat is in a non-operative position.

The microprocessor may be connected to a wireless transmission means, which may be, for example, a cellular telephone connection. Transmissions may be initiated in the event of a malfunction or as a result of inquiry from a remote supervisory source allowing, for example, a determination of the level of sleeve supplied.

BRIEF DESCRIPTION OF THE DRAWINGS

A fuller understanding of the present invention and the features and operation thereof will be made upon consideration of the following detailed description of a preferred, but nonetheless illustrative embodiment of the invention when considered in connection with the annexed drawings, wherein.

DETAILED DESCRIPTION OF THE INVENTION

Figure 1:
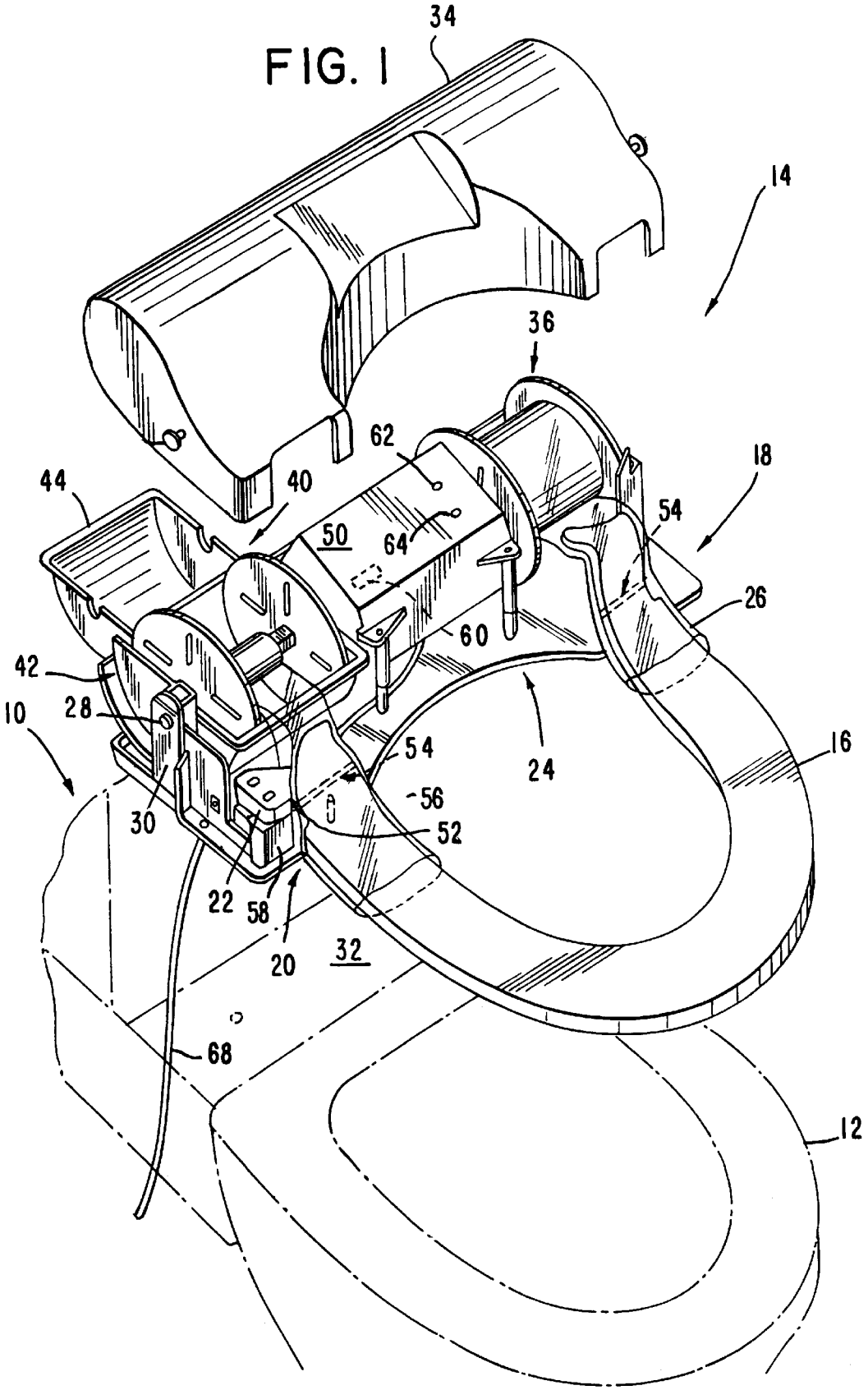
FIG. 1 is a perspective view of the drive apparatus of the invention in an exploded form, presenting an associated toilet apparatus in phantom.

As seen in FIG. 1, a toilet 10 of conventional construction includes a bowl 12 with which the present invention is associated. Seat 16 is generally loop-shaped in plan, having a first end 18 and a second end 20. The seat may sit upon the bowl 12 by virtue of a plurality of downward-extending projections or knobs (not shown) projecting from the lower surface of the seat. The knobs limit the area of contact between the seat and bowl, and thus facilitate movement of the sleeve material around the seat.

The second end 20 of seat 16 is formed with a connecting arm 22, which affixes the seat to lower housing 24. The first end 18 of the seat is free from the housing to permit the sleeve material 26 to encase the seat. The combination of lower housing 24 and seat 16 are pivotally affixed by a pair of axles 28 extending through the opposed arms of a U-shaped mounting bracket 30, the base of which is mounted to the toilet, and typically to horizontal fixture portion 32 behind bowl 12 by appropriate fasteners (not shown). The entire seat assembly may be rotated about the axles upwardly away from the bowl into a vertical position. An upper housing 34 covers the lower housing and the components mounted thereon.

Tubular seat-embracing sleeve material 26, typically polyethylene or other plastic film, is provided as an extended length on a supply reel 36 mounted proximate the first end of the seat 16. Supply reel 36 is mounted for free rotation about its axle 28, which is supported within lower housing 24 in a manner to allow the sleeve material to be fed onto the seat 16 with minimal resistance. The brackets which support the axle may be dimensioned and arranged in a known manner to allow insertion of a loaded reel and removal of an empty reel.

Take-up reel 40, which may be similar in construction to supply reel 36, is rotatably mounted on lower housing 34 proximate the second end 20 of the seat. The take-up reel may be housed in a removable cassette unit 42 of a clamshell-like configuration, having a pivoting upper half 44 which allows access to the reel for engagement of the leading end of the sleeving 26 for take-up, and which may be closed to provide a convenient receptacle for the used sleeving and to prevent contact therewith. A similar cassette may be provided for supply reel 36. The cassettes may be formed of plastic, and may be of one-piece construction with an integral hinge 46 joining the top and bottom sections. Take-up reel 40 is preferably directly driven by a motor-gear drive means unit 48 which is mounted within central module 50, in turn mounted to the lower housing 24. The motor-gear set is chosen to provide sufficient torque to wind the sleeve material 26 upon the take-up reel 40 when energized, thereby pulling the sleeve material along the length of the seat whereby a new length of the sleeve is dispensed onto the seat from the supply reel 36. The motor-gear set may preferably utilize a 115 r.p.m., 12 volt d.c. motor coupled to a gear train having an overall 65.5:1 ratio (motor:output) producing 175 ounce-inches of torque.

Because seat 16 is mounted to the lower housing 24 at its second end 20, means must be provided to allow the sleeve material to exit from the seat for take-up on reel 40. Accordingly, a knife 52 is provided and positioned such that, as the sleeve material is pulled by the take-up reel, it is slit along its length, allowing the sleeve to pass off connecting arm 22 and the fixed second end of the seat. The knife may be mounted to the forward end of seat connecting arm 22 in a horizontal position to slit the outer side of the sleeve as it passes the blade.

In order to provide appropriate control signals to the motor-gear set to allow a correct amount of sleeve to be dispensed onto the seat upon command, the sleeving 26 is provided with a plurality of registration marks at regular intervals along its length. As may be seen, such marks may preferably constitute a plurality of equally spaced transverse lines or hash marks 54, preferably located on the bottom surface of the sleeve as oriented upon the seat.

A sensor 56, preferably located proximate the second end of the seat just forward of the knife 52 and mounted to the lower housing 24 upon pedestal 58, is positioned such that its active face points upwardly whereby the sensed zone intersects with the travel of the marks 54 as the sleeve material is taken up by take-up reel 40. The sensor may preferably be an opto-transistor, as known in the art, which includes an integral light source, typically infrared, and a mating radiation detector in the form of a semiconductor junction. The detector changes conductivity upon the sensing of radiation of the wavelengths emitted by the source, thus serving as a semi-conductor switch. The marks 54, typically of substantially opaque black ink, absorb a substantially greater amount of the emitted radiation than the unmarked portions of the sleeve, which are typically clear or of a light color, thus causing the semiconductor switch to toggle between conducting and non-conducting states as the line passes across the sensing zone of the sensor. The output of sensor 56 is coupled to the control circuitry, whereby the operation the motor-gear set 48 is controlled.

Figure 2:
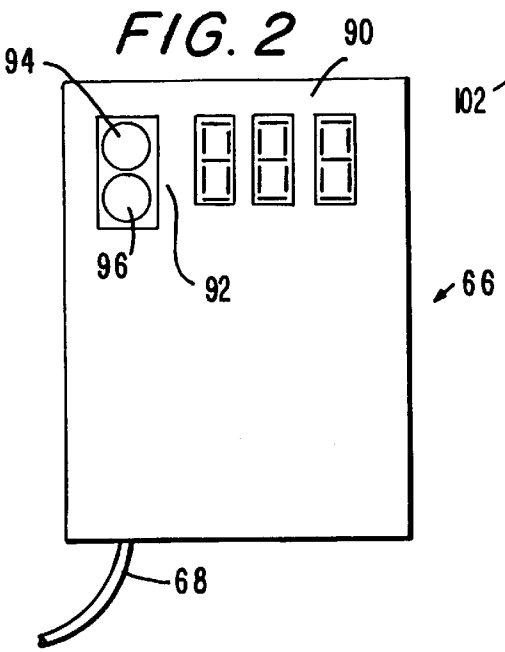
FIG. 2 is a front elevation view of a cabinet for the microprocessor portion of the controller circuitry.

A second sensor 60, which may be mounted within central housing module 50, monitors the position of the seat 16. The sensor may preferably be a mercury switch or other orientation-sensitive device, providing a first signal when the seat system is in the operative down position as shown in FIG. 1, and a second signal when the seat is in the raised position, such as when pivoted about the axles 28 to a vertical orientation. Input means, such as switches 62 and 64, may be mounted on motor drive unit 48 to allow data concerning the length of sleeve material loaded on supply reel 36 to be received by the controller circuitry. The components located at the seat are coupled to control unit 66 as shown in FIG. 2 by cable 68.

Figure 4:
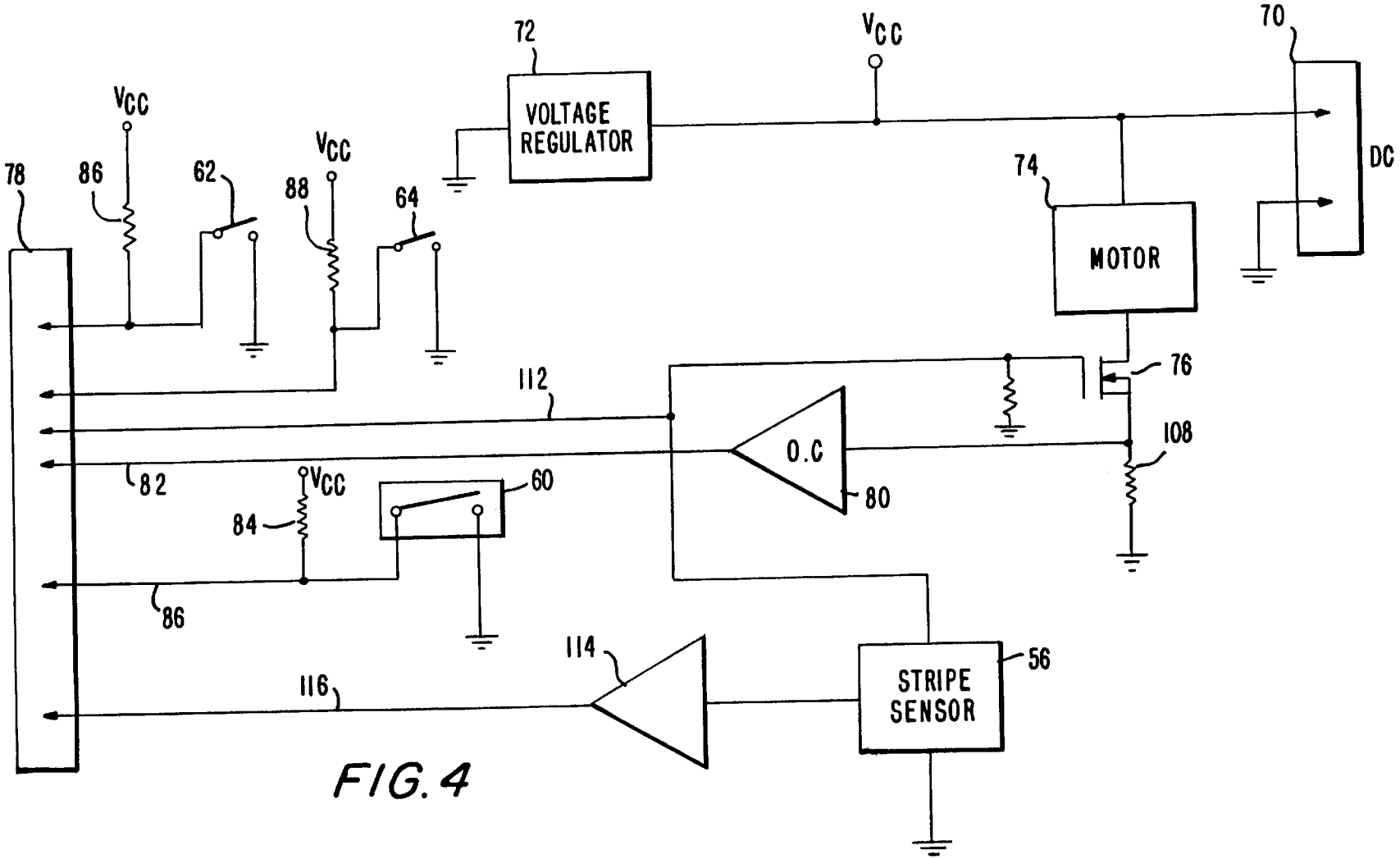
FIG. 4 a block diagram of a second, microprocessor-containing portion of the controller circuitry.

The circuitry located at the seat is depicted in FIG. 4. As presented therein, power is provided by the remote control unit 66, entering through connector 70. Voltage regulator 72 maintains a constant potential for the components. Motor 74 is in series with motor switch 76, which may be a field-effect transistor, and low value (typically 0.22 ohm) resistor 108 between the positive potential and ground. The control input on line 112 to the motor switch is provided by the remote control unit through connector 78.

An overcurrent sensor 80, which may be fashioned about an operational amplifier configured as a comparator, senses the current passing through resistor 108 and provides a high/low output on line 82 through connector 78 to remote control unit 66 based on the relation between the sensed current and a reference value, typically chosen to be somewhat higher than normal operating current. The comparator circuit may include a time constant circuit on its input side to avoid triggering the comparator as a result of short duration transients, which may occur, for example, on motor start-up.

Position sensor 60 is coupled between positive voltage and ground through a resistor 84 whereby the voltage on line 86 will toggle between high and low, depending on the condition of the switch and thus the position of the seat 16. Line 86 is coupled to connector 78.

The output of stripe sensor 56, which is a series of pulses corresponding to the passage of the stripes 54 during sleeve dispensation, is passed through threshold/conditioner 114 to the remote control unit through line 116 to connector 78. The motor control input of line 112 may be used to activate the sensor to prevent the generation of false output signals when the sleeve material is not being dispensed.

Switches 62 and 64 are coupled between high potential and ground by corresponding resistors 88, allowing an appropriate high or low voltage condition to be transmitted through connector 78 to the processor to properly set an internal counter for dispensation decrementing as required. Preferably, the sleeving materials is provided in cassettes having a length of sleeve appropriate for a predetermined number of dispensations, such as 100 or 200, the control system decrementing a count from the original number by one upon each operation. As depicted in the Figure, the switches 62 and 64 allow for inputting of a control signal or bit corresponding to the size cassette utilized. Alternatively, means may be provided to set a chosen alternative start number or value for particular applications.

Connectors 70 and 78 feed cable 68 which leads to remote control unit 66, which may for example be located on the bathroom wall above and behind the toilet 10. As depicted in FIG. 2, the remote control unit may include for external observation a read-out 90 in the form of a light-emitting diode array as known in the art, which illustrates numerically the number of remaining operations available for the length of sleeving on the supply reel 36. The remote control unit also supports second operation activation sensor 92, which may preferably comprise an opto-transistor or similar semiconductor element having infrared emitter 94 and associated receiver 96. Coupled to the control system, the sensor recognizes the close proximity of an object, such as a hand, placed in front of the sensors. The presence of a hand constitutes a signal to commence a new dispensation cycle. The remote control unit is typically mounted in a location such that the sensor 92 relatively immune from unwanted motions which would otherwise trigger a dispensation.

Figure 3:
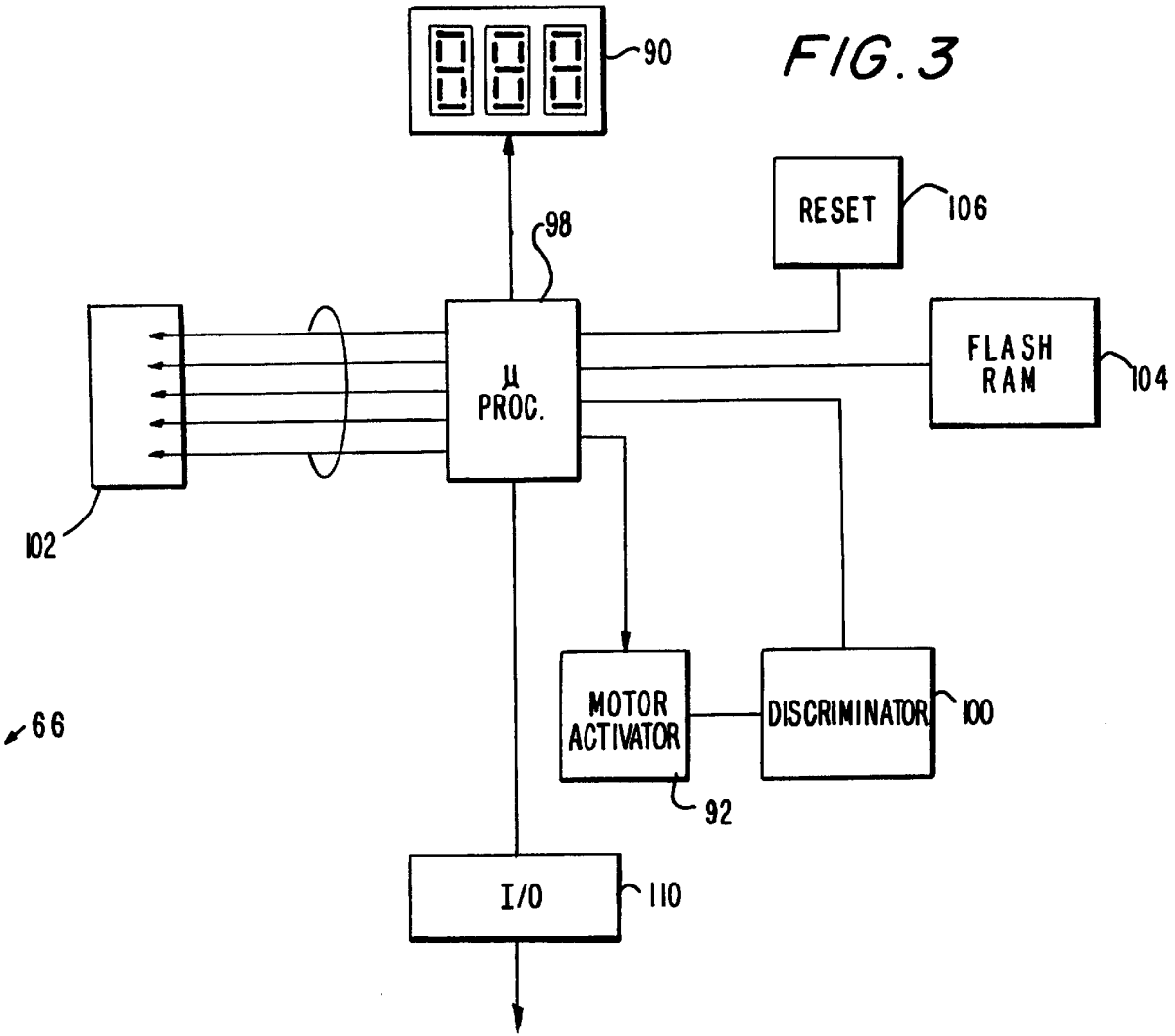
FIG. 3 is a block diagram of a first portion of the controller circuitry located at the seat.

A block diagram depicting the control circuitry within the remote control unit is set forth in FIG. 3. As depicted therein, microprocessor 98 controls overall system operation. As known in the art, the microprocessor is powered by an appropriate direct current source (not shown) typically provided by a power supply connected to the a.c. mains. The microprocessor may be, for example, a PIC16C64. Motor activation sensor 92 is coupled to the microprocessor. Preferably, the microprocessor provides a modulated drive to the infrared transmitter portion, the reflected signal as received by the receiver portion being passed through a discriminator circuit 100 as known in the art tuned to the modulation frequency to eliminate ambient light effects. Microprocessor 98 utilizes a valid signal received from the motor activator to operate motor 74, the signal being passed through the cable 68 through connector 102. LED display 90 is also driven by the microprocessor as known in the art, and displays the remaining number of usages available, based on the number of motor activations. The initial number of dispensations available, as input through the switches 62, 64 at the motor, is stored in flash ram memory 104, along with the decremented value. Particularly when a low capacity microprocessor with volatile memory is employed, the inclusion of a separate ram array, whose contents are not destroyed upon a lack of power, improves the reliability of operation. Reset 106, also coupled to the microprocessor, allows a clearing of the contents of the microprocessor when required.

In addition to controlling the motor drive voltage, microprocessor 98 also processes the data received from and monitors the condition of the motor over-current sensor 80. In the event of a motor stall or jam or similar malfunctions which would cause an over-current situation, the microprocessor recognizes the overcurrent signal provided by the sensor and shuts off power to the motor. When the situation is cleared, power to the motor is restored. Microprocessor 98 also receives the seat position signal generated by second sensor 60 to prevent motor operation if the seat is in a vertical position. Typically, the current sensor 80 is set to toggle at approximately 2 amperes.

Microprocessor 98 may be further connected to input/output system 110. At a first level of implementation, the microprocessor may provide a set of outputs when, for example, the dispenser is fully depleted of material, as well as when a small amount, such as for example, 10 uses, remain. The input/output system provides communication with a remote control location. In an alternative embodiment, two-way communication can be provided including, for example, the ability to receive an inquiry from the central location concerning the number of dispensations available, the status of the system, as well as being able to implement a system reset and respond to such inquiries. Transmissions may be through telephone lines or wireless (cellular) communications, in which a appropriate dialer/receiver, as known in the art can be provided, either in the control module or displaced therefrom. In addition, the input/output system may also provide outputs to allow other tasks to be performed. For example, an output signal can be generated after each successful dispensation to allow a timed release of a disinfectant spray.

I claim:

1. Apparatus for supplying a cover on a toilet seat comprising: a toilet seat, means for dispensing a fresh length of fresh cover material from a supply reel onto the seat and for take-up of used cover material from the seat; and sensor means for sensing the position of the seat and for generating a disable signal to said dispensing means to prevent dispensation when the seat is in a vertical position, said dispensing means including a pair of switches corresponding to alternative lengths of cover material for inputting data representing the length of fresh cover material available to be dispensed onto the seat.

2. The apparatus of claim 1, wherein said dispensing means includes a drive motor and an overcurrent sensor coupled to said drive motor to monitor the current draw of the drive motor.

3. The apparatus of claim 2, wherein said overcurrent sensor includes a comparator to compare drive motor current to a reference value.

4. The apparatus of claim 1 further comprising display means for exhibiting data concerning the amount of fresh cover material remaining on the supply reel.

5. The apparatus of claim 4, wherein said dispensing means exhibits a number representing the dispensations available for the amount of fresh cover material remaining on the supply reel.

6. The apparatus of claim 4 further comprising means for generating an output signal when the number of dispensations available decreases to a given value.

7. The apparatus of claim 6 further comprising communication means for receiving said output signal and transmitting data associated therewith to a control location.

8. The apparatus of claim 7, wherein said communication means includes means for the processing of inquiry signals from the control location and the transmission of responses thereto to the control location.

9. The apparatus of claim 8, wherein said communication means includes means for processing inquiry signals concerning the number of dispensations of lengths of fresh cover material available.

10. The apparatus of claim 8, wherein said communication means includes means for processing inquiry signals concerning the status of the dispensing means.

11. The apparatus of claim 1 further comprising means for controlling the dispensation of the length of fresh cover material and take up of used material by a non-contact actuator.

12. The apparatus of claim 11, wherein said means for controlling the dispensation comprises an infrared sensor system.

13. The apparatus of claim 12, wherein said infrared sensor system is located remote from said toilet seat.

* * * * *